US008006325B2

(12) United States Patent
Stimpson et al.

(10) Patent No.: US 8,006,325 B2
(45) Date of Patent: Aug. 30, 2011

(54) PUMPED SHOWER DRAIN SYSTEM

(75) Inventors: Robert William Stimpson, Douglas (GB); Graham Robin Lock, Glen Vine (GB); James Edward Self, Colby (GB)

(73) Assignee: DLP Limited, Isle of Man, British Isles (GB)

( * ) Notice: Subject to any disclaimer, the term of this patent is extended or adjusted under 35 U.S.C. 154(b) by 303 days.

(21) Appl. No.: 12/447,481

(22) PCT Filed: Jul. 16, 2007

(86) PCT No.: PCT/GB2007/002656

§ 371 (c)(1),
(2), (4) Date: Apr. 28, 2009

(87) PCT Pub. No.: WO2008/053133

PCT Pub. Date: May 8, 2008

(65) Prior Publication Data

US 2010/0065136 A1 Mar. 18, 2010

(30) Foreign Application Priority Data

Oct. 31, 2006 (GB) ..... 0621605.5

(51) Int. Cl.

| | |
|---|---|
| ***F04B 53/10*** | (2006.01) |
| ***F04B 45/04*** | (2006.01) |
| ***F04B 43/02*** | (2006.01) |
| ***E03C 1/22*** | (2006.01) |
| ***E03C 1/12*** | (2006.01) |

(52) U.S. Cl. ..... 4/613; 137/512.3; 417/456

(58) Field of Classification Search ..... 4/546, 559, 4/597, 605, 613, 665; 137/512, 512.3, 312; 417/456–458, 569

See application file for complete search history.

(56) References Cited

U.S. PATENT DOCUMENTS

| | | | | |
|---|---|---|---|---|
| 700,403 | A * | 5/1902 | Block | 137/512 |
| 3,007,527 | A * | 11/1961 | Nelson | 166/326 |
| 3,072,145 | A * | 1/1963 | Nelson | 137/846 |

(Continued)

FOREIGN PATENT DOCUMENTS

| | | |
|---|---|---|
| DE | 2000 561 A1 | 7/1971 |

(Continued)

OTHER PUBLICATIONS

International Search Report mailed Oct. 10, 2007 for PCT/GB2007/002656 filed Jul. 16, 2007.

(Continued)

*Primary Examiner* — Robert J Canfield

(74) *Attorney, Agent, or Firm* — Martin Fleit; Paul D. Bianco; Fleit Gibbons Gutman Bongini & Bianco PL

(57) ABSTRACT

A pumped shower drain system (10) comprises a shower base (12), a waste water unit (14) provided on the shower base (12) and having a waste water inlet (28) and a waste water outlet (30), and a reciprocating water pump (20) for pumping water from the waste water unit (14) to a drain (22). The reciprocating water pump (20) includes: a pump housing (40) having a pump inlet (48) in liquid communication with the waste water outlet (30) of the waste water unit (14), and a pump outlet (50) in liquid communication with the drain (22); first and second inlet valve seals (56, 58) in spaced relationship; and first and second outlet valve seals (84, 86) in spaced relationship. Each set of inlet and outlet valve seals comprise different kinds of valve seals from each other, and are independently closable to close the pump inlet or outlet. Preferably, the inlet valve seals and/or the outlet valve seals have different modes of operation.

19 Claims, 4 Drawing Sheets

U.S. PATENT DOCUMENTS

| | | | | | |
|---|---|---|---|---|---|
| 3,203,357 | A | * | 8/1965 | Delorme | 417/454 |
| 3,342,208 | A | * | 9/1967 | Steffes | 137/516.11 |
| 3,354,831 | A | * | 11/1967 | Acker et al. | 417/387 |
| 3,514,231 | A | * | 5/1970 | Perry et al. | 417/565 |
| 3,599,657 | A | * | 8/1971 | Maldavs | 137/102 |
| 4,217,921 | A | * | 8/1980 | Gidner | 137/218 |
| 4,272,225 | A | * | 6/1981 | Fujinaka et al. | 417/417 |
| 4,321,018 | A | * | 3/1982 | Hurt | 417/229 |
| 5,011,382 | A | * | 4/1991 | Thompson | 417/571 |
| 5,320,504 | A | * | 6/1994 | Lundback | 417/479 |
| 5,655,894 | A | * | 8/1997 | Fritsch | 417/387 |
| 6,354,819 | B1 | * | 3/2002 | Parikh et al. | 417/454 |
| 7,331,360 | B2 | * | 2/2008 | Camis, Jr. | 137/512.3 |
| 2006/0169329 | A1 | * | 8/2006 | Camis | 137/512 |
| 2008/0219856 | A1 | * | 9/2008 | Stimpson | 417/36 |
| 2010/0083439 | A1 | * | 4/2010 | Stimpson | 4/613 |

FOREIGN PATENT DOCUMENTS

| | | | | |
|---|---|---|---|---|
| FR | 2 328 864 | A1 | | 5/1977 |
| FR | 2527700 | A1 | | 12/1983 |
| GB | 2 278 776 | A | | 12/1994 |
| GB | 2424368 | A | | 9/2006 |
| GB | 2 432 195 | A | * | 5/2007 |
| GB | 2 443 422 | A | * | 5/2008 |

OTHER PUBLICATIONS

British Search Report completed Jan. 19, 2007 for Application No. GB0621605.5 filed Oct. 31, 2006.

Written Opinion of the International Searching Authority published Apr. 30, 2009 for PCT/GB2007/002656 filed Jul. 16, 2007.

* cited by examiner

PUMPED SHOWER DRAIN SYSTEM

FIELD OF THE INVENTION

This invention relates to a pumped shower drain system, particularly, but not exclusively, for domestic use.

BACKGROUND OF THE INVENTION

Detritus and particulate matter often becomes entrained in waste water run off from a shower. This debris can originate from the user of the shower, and be in the form of hair and skin, for example, but can also be rubbish and rubble which has accidentally fallen into the outlet of the shower tray or waste unit, for example, during installation. Further debris remaining from the manufacturing processes of the various parts of a pumped shower drain system is also commonly found in the waste unit and drainage pipes.

When utilising a pump to move water from a waste unit of a shower tray to a drain, the above-mentioned debris can often block an inlet or outlet seal of the pump, leading to malfunction.

The present invention seeks to provide a solution to this problem.

SUMMARY OF THE INVENTION

According to a first aspect of the invention, there is provided a pumped shower drain system comprising a shower base, a waste water unit provided on the shower base and having a waste water inlet and a waste water outlet, and a reciprocating water pump for pumping water from the waste water unit to a drain, the reciprocating water pump including: a pump housing having a pump inlet in liquid communication with the waste water outlet of the waste water unit, and a pump outlet in liquid communication with the drain; first and second inlet valve seals in spaced relationship, the inlet valve seals being different kinds of seals from each other and being independently closable to close the pump inlet; and first and second outlet valve seals in spaced relationship, the outlet valve seals being different kinds of seals from each other and being independently closable to close the pump outlet.

According to a second aspect of the invention, there is provided a reciprocating water pump for pumping waste water from a shower waste water unit to a drain, the reciprocating water pump comprising: a pump housing having a pump inlet for connection to a waste water outlet of the waste water unit, and a pump outlet for connection to a drain; first and second inlet valve seals in spaced relationship, the inlet valve seals being different kinds of seals from each other and being independently closable to close the pump inlet; and first and second outlet valve seals in spaced relationship, the outlet valve seals being different kinds of seals from each other and being independently closable to close the pump outlet.

BRIEF DESCRIPTION OF THE DRAWINGS

The invention will now be more particularly described, by way of example only, with reference to the accompanying drawings, in which.

DETAILED DESCRIPTION OF THE INVENTION

Figure 1:
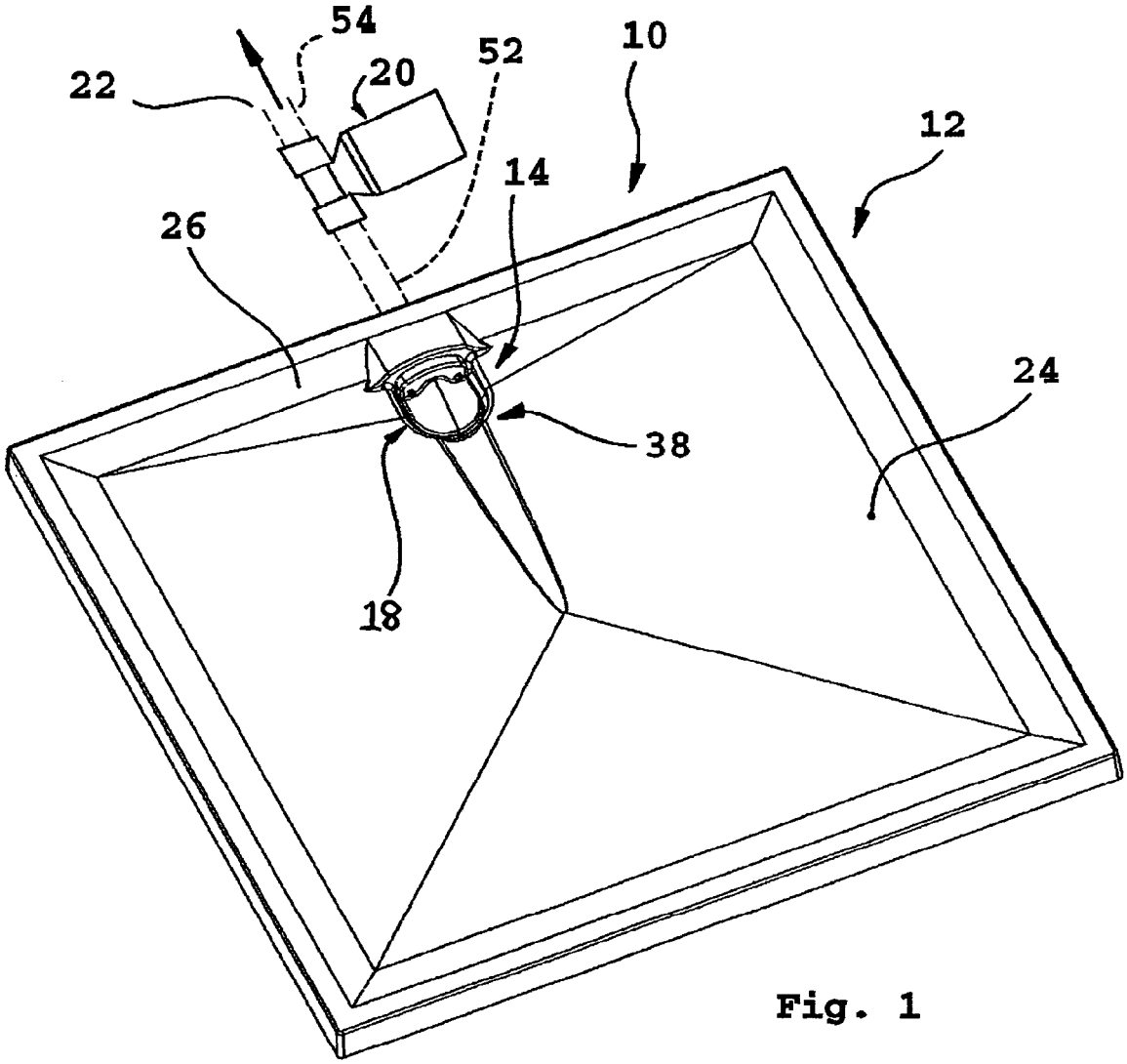
FIG. 1 is a perspective view of one embodiment of a pumped shower drain system, according to the first aspect of the invention.
Figure 2:
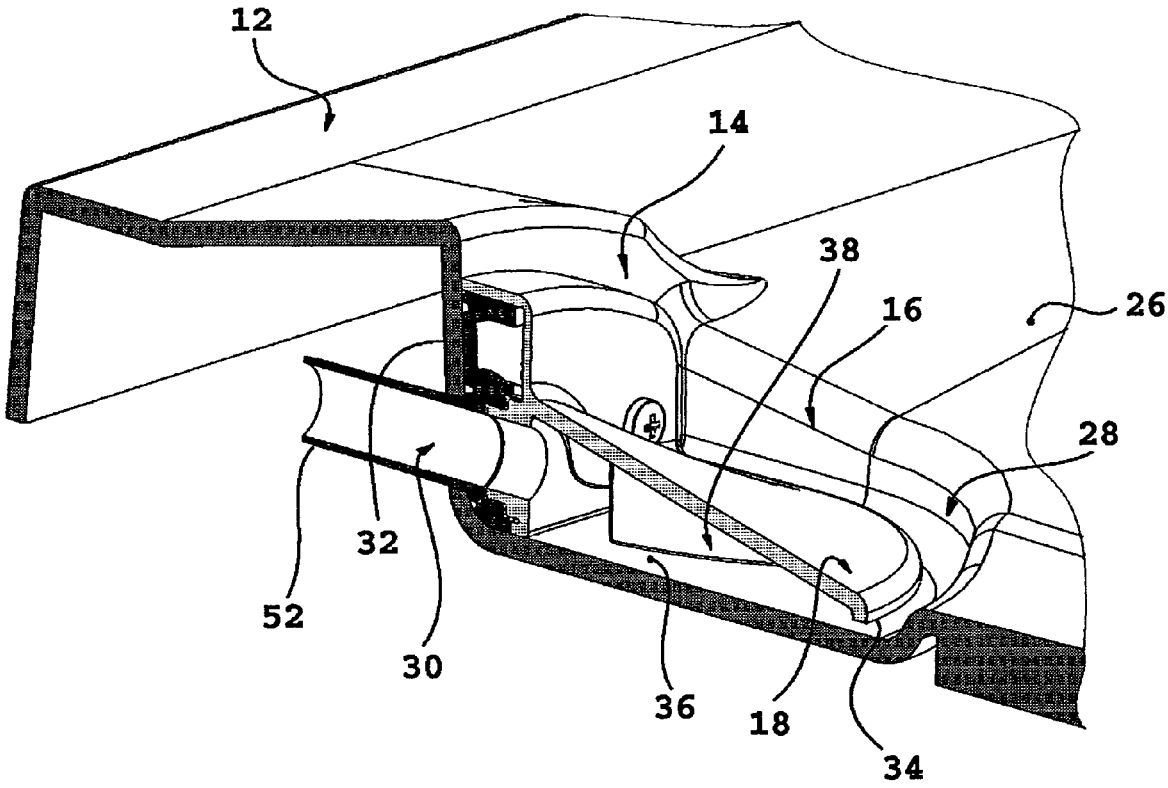
FIG. 2 is a cross-sectional view through a shower base and waste water unit of the pumped shower drain system, shown in FIG. 1.
Figure 3:
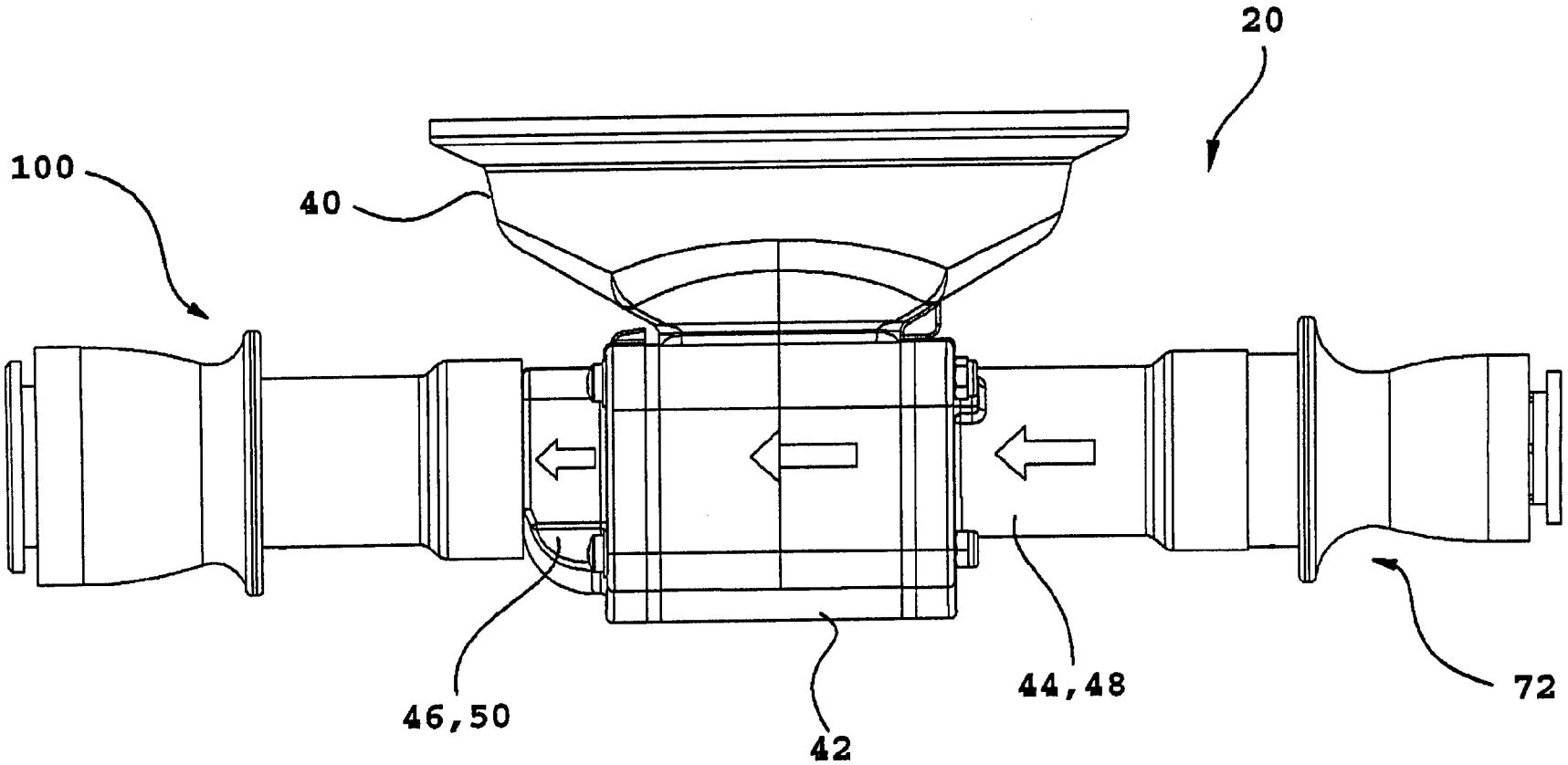
FIG. 3 is an elevational view of part of a reciprocating diaphragm pump forming part of the pumped shower drain system, shown in FIG. 1 and according to the second aspect of the invention.

Referring firstly to FIGS. 1 and 2 of the drawings, there is shown a pumped shower drain system 10 which comprises a shower tray 12 for location on or recessed within the depth of standard floor joists, being typically in the range of 60 to 100 millimeters, a waste water unit 14 which includes a body 16 integrally formed within the depth of the shower tray 12, a duck-bill shaped housing 18 provided within the body 16, and optionally a removable cover (not shown) which covers the housing 18 and the body 16, and a reciprocating water pump 20 for pumping water from the waste unit 14 to a drain 22.

The shower tray 12 includes a user-supporting portion 24 which has a predetermined fall towards the waste water unit 14, and upraised sides 26 which surround the user-supporting portion 24. The shower tray 12 can be formed in any suitable manner, for example by moulding or hand lay-up, and can be formed from any suitable material, for example glass-reinforced plastics or sheet moulding compound.

The waste water unit 14 has a waste water inlet 28, which is typically formed between the perimeter of the cover and an upper edge of the body 16, and a waste water outlet 30 which is formed through a back-wall 32 of the body 16. The housing 18 is attached to the back-wall 32 of the body 16, and thus covers the waste water outlet 30. A lower perimeter edge 34 of the housing 18 is below the waste water outlet 30 and is supported so as to be spaced from the bottom surface 36 of the body 16. The shape of the housing 18 prevents or suppresses noise caused during pump operation and due to entrainment of air with the waste water being drawn out of the body 16. The housing 18 thus generally acts as a sump 38.

Although not shown, the waste water unit can include a trap.

The reciprocating water pump 20 comprises a pump housing 40 in which is housed a reciprocating diaphragm coupled to a connecting rod (not shown) driven by an electric motor (also not shown). The reciprocating water pump 20, in this embodiment, is thus a diaphragm pump. Since these elements of the pump are common, and thus further description is omitted.

The pump housing 40 includes a pump chamber 42, a valve inlet body 44, and a valve outlet body 46. The valve inlet body 44 and the valve outlet body 46 are mechanically attached, for example via bolts, or are integrally formed as part of the pump chamber 42 of the pump housing 40.

The valve inlet body 44 defines a waste water inlet port 48, and the valve outlet body 46 defines a waste water outlet port 50. The waste water inlet port 48 is in liquid communication with the waste water outlet 30 of the waste water unit 14, typically interconnected via a pipe 52, and the waste water outlet port 50 is in liquid communication with the drain 22, again typically via pipework 54.

First and second inlet valve seals 56, 58 are provided in the waste water inlet port 48. The first and second inlet seals 56, 58 are spaced from each other along a flow path FP1 defined by the waste water inlet port 48, and are operable independently of each other. The first inlet seal 56 is a first elastomeric flap valve seal 60 which is interposed between the valve inlet body 44 and the pump chamber 42. The second inlet seal 58 is a first elastomeric tricuspid valve seal 62 which is provided upstream of the flap valve seal 60. An passage 64 of the waste water inlet port 48 is formed with a stepped bore 66. The larger diameter portion of the stepped bore 66 is at and adjacent to the opening, and includes an internal screw-thread 68. A shoulder 70 is defined between the screw-thread 68 and the smaller diameter portion of the stepped bore 66. The first tricuspid valve seal 62 is seated on the shoulder 70, and a, typically push-fit speed type, pipe coupling 72 is threadingly engaged with the internal screw-thread 68. The first tricuspid valve seal 62 is thus liquid-tightly held against the shoulder 70 by the pipe coupling 72, and extends along the valve inlet body 44 towards, but not as far as, the pump chamber 42.

The first flap valve seal 60 includes an elastomeric flap seal element 74 which is hinged at one edge, and a biasing element 76 which urges the flap seal element 74 towards the closed position. The flap seal element 74 thus opens into the pump chamber 42 of the pump housing 40, and seals against an interior surface of the pump chamber 42 to close the inlet port 48. As such, the flap seal element 74 moves to open and close in a direction parallel or substantially parallel to a flow path FP1 of liquid entering the pump housing 40.

Figure 4:
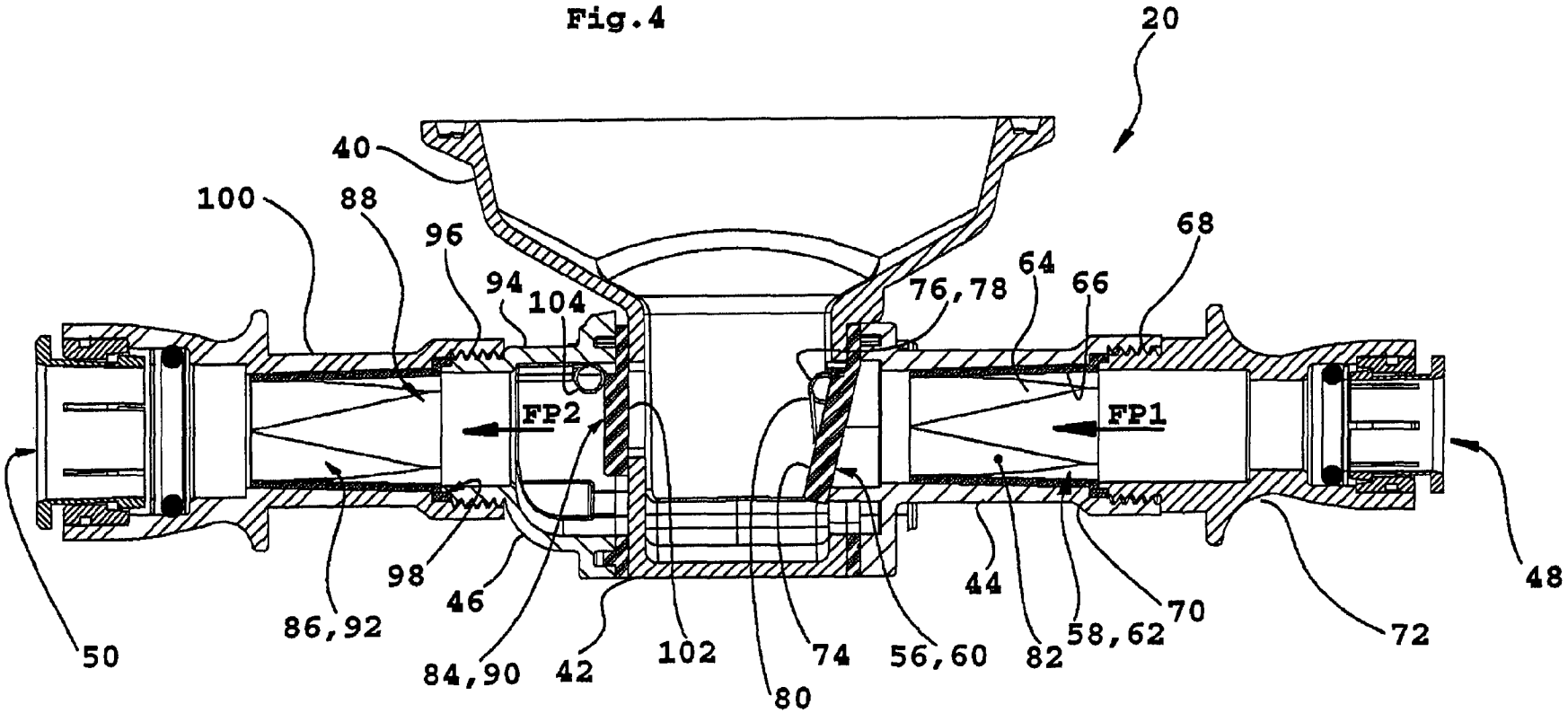
FIG. 4 is a cross-sectional view of the diaphragm pump, taken along the longitudinal extent.

The biasing element 76 is a torsion bar spring 78 which includes a lateral bar element which contacts a downstream facing surface of the flap seal element 74, and which extends in parallel with the axis of hinging of the flap seal element 74 (extends perpendicularly into the plane of the paper in FIG. 4). The torsion bar spring 78 also includes two spaced arm elements 80 which extend in parallel, or substantially in parallel, from opposite ends of and generally perpendicular to the lateral bar element.

A torsion bar spring 78 is particularly beneficial, since the gauge of material can be easily altered, the arm length can be adjusted, and the number of coils and the diameter of the coils can be changed to enable a multitude of adjustments to be performed depending upon the installation environment and requirements of the pump. The material of the torsion bar spring 78 is preferably Grade 302 stainless steel conforming to BS2056 type 302S26. Stainless steel is preferable, since it is less likely to fatigue when compared to, for example, plastics, and it also has good corrosion resistance characteristics. However, other materials meeting these criteria could be used.

The first tricuspid valve seal 62 includes three flexible inwardly-biased side walls 82 which, when the valve is in a closed condition, are concaved sufficiently to meet and press against each other. When liquid flows into the tricuspid valve seal 62, the side walls 82 are urged outwards away from each other by the liquid, and transversely or substantially transversely to the direction of the flow path FP1 of the water through the seal 62.

Similarly to the first and second inlet seals 56, 58, first and second outlet valve seals 84, 86 are provided in the waste water outlet port 50. The first and second outlet seals 84, 86 are also spaced from each other along a flow path FP2 defined by a passage 88 of the waste water outlet port 50, and are operable independently of each other. The first outlet seal 84 is a second elastomeric flap valve seal 90 which is interposed between the valve outlet body 46 and the pump chamber 42. The second outlet seal 86 is a second elastomeric tricuspid valve seal 92 which is provided downstream of the second flap valve seal 90.

The valve outlet body 46 includes a stepped exterior surface 94. A screw-thread 96 is formed on the exterior surface 94 adjacent to the end of the valve outlet body 46. A shoulder 98 is formed between the end of the valve outlet body 46 and the screw-thread 96. The second tricuspid valve seal 92 is seated on the shoulder 98, and a, typically push-fit speed type, pipe coupling 100 is threadingly engaged with the exterior screw-thread 96. The second tricuspid valve seal 92 is thus liquid-tightly held against the shoulder 98 by the pipe coupling 100.

As with the first flap valve seal 60, the second flap valve seal 90 includes a flap seal element 102 which is hinged at one edge, and a biasing element 104 which urges the flap seal element 102 towards the closed position. The flap seal element 102 opens into the valve outlet body 46, and seals against an exterior surface of the pump chamber 42 to close the outlet port 50. As such, the flap seal element 102 of the second flap valve seal 90 moves to open and close in a direction parallel or substantially parallel to a flow path FP2 of liquid exiting the pump housing 40 and flowing along the passage 88.

The biasing element 104 is a torsion bar spring 106, as described above, and thus further description is omitted.

The second tricuspid valve seal 92 extends from the valve outlet body 46 and along the pipe coupling 100. However, the other features of the second tricuspid valve seal 92 are as described above, and thus further description is omitted.

Other kinds of biasing elements, aside from a torsion bar spring, could feasibly be used. However, the above-described torsion bar spring is beneficial since it does not or hardly obstructs the flow path of fluid from the diaphragm housing. It is envisaged that a leaf type spring could be utilised instead.

Although a tricuspid valve seal is suggested, any multi-cuspid valve seal can be used, for example, a bicuspid valve seal or a quadcuspid valve seal.

Any suitable material can be used for the flap seal element, such as stainless steel or plastics, and also for the tricuspid valve, for example any rubber or even plastics material.

The valve seals either side of the pump chamber are suggested as being a flap valve seal and a multi-cuspid valve seal. However, any valve seals and any combination of valve seals can be utilised, and can be selected based on the environment in which the installation is taking place. Consequently, the first and second valve seals on the inlet side do not have to be the same as those on the outlet side.

However, it is essential that the first valve seal is of a different kind to the second valve seal.

Although the provision of first and second valve seals on each side of a pump housing of a diaphragm water pump is described, the valve seals can be provided on any reciprocating water pump.

The shower tray can be any type of shower base, such as a level-entry tray, a higher 'step-over' type non-recessed tray, or a former for forming a fall beneath flexible plastics waterproof floor covering material, such as Altro®, when tanking a shower area.

It is thus possible to provide a pumped shower drain system which has a reciprocating water pump for pumping 'grey' waste water from a shower waste water unit to a drain and which is less prone to malfunction through blockage. By including two independent valve seals on each side of the pump chamber, if one valve seal becomes blocked, the other valve seal is still likely to correctly function, thus allowing continued operation. During the continued operation, it is likely that the blockage will disperse, dispensing with the need for immediate servicing. Furthermore, by using two different kinds of valve seals which operate simultaneously or consecutively, but with different modes of operation, debris causing blockage of one valve seal is less likely to impact the operation of the other valve seal.

The embodiment described above are given by way of examples only, and various other modifications will be apparent to persons skilled in the art without departing from the scope of the invention, as defined by the appended claims.

The invention claimed is:

1. A pumped shower drain system comprising:

a shower base (12);

a waste water unit (14) provided on the shower base (12) and having a waste water inlet (28) and a waste water outlet (30); and a reciprocating water pump (20) for pumping water from the waste water unit (14) to a drain, the reciprocating water pump (20) including:

a pump housing (40) having a pump inlet (48) in liquid communication with the waste water outlet (30) of the waste water unit (14), and a pump outlet (50) in liquid communication with the drain;

first and second inlet valve seals (56, 58) in spaced relationship, the inlet valve seals (56, 58) being different kinds of seals from each other and being independently closable to close the pump inlet (48); and first and second outlet valve seals (84, 86) in spaced relationship, the outlet valve seals (84, 86) being different kinds of seals from each other and being independently closable to close the pump outlet (50).

2. A pumped shower drain system as claimed in claim 1, wherein the shower base (12) is a former for forming a fall beneath flexible waterproof floor covering material.

3. A pumped shower drain system as claimed in claim 1, wherein the shower base (12) is a tray having sides and a base on which a user directly stands during use.

4. A pumped shower drain system as claimed in claim 1, wherein the waste water unit (14) includes a sump and/or trap (38).

5. A pumped shower drain system as claimed in claim 1, wherein the waste water unit (14) has a depth which is equal to or less than a depth of a standard floor joist.

6. A pumped shower drain system as claimed in claim 1, wherein the reciprocating water pump (20) is a diaphragm pump.

7. A pumped shower drain system as claimed in claim 1, wherein the first inlet valve seal (56) is movable to open and close in a direction parallel or substantially parallel to a flow path of liquid into the pump housing (40).

8. A pumped shower drain system as claimed in claim 7, wherein the first inlet valve seal (56) is a flap valve seal (60).

9. A pumped shower drain system as claimed in claim 7, wherein the first inlet valve seal (56) is a flap valve seal (60) that includes a flap seal element (74) hinged at one edge, and a biasing element (76) which urges the flap seal element (74) towards a closed position.

10. A pumped shower drain system as claimed in claim 1, wherein the second inlet valve seal (58) is movable to open and close in a direction transverse or substantially transverse to a flow path (FP1) of liquid into the pump housing (40).

11. A pumped shower drain system as claimed in claim 10, wherein the second inlet valve seal (58) is a multi-cuspid valve (62).

12. A pumped shower drain system as claimed in claim 1, wherein the first outlet valve seal (84) is movable to open and close in a direction parallel or substantially parallel to a flow path of liquid out of the pump housing (40).

13. A pumped shower drain system as claimed in claim 12, wherein the first outlet valve seal (84) is a flap valve seal (90).

14. A pumped shower drain system as claimed in claim 12, wherein the first outlet valve seal (84) is a flap valve seal (90) that includes a flap seal element hinged at one edge, and a biasing element which urges the flap seal element towards a closed position.

15. A pumped shower drain system as claimed in claim 1, wherein the second outlet valve seal (86) is movable to open and close in a direction transverse or substantially transverse to a flow path (FP1) of liquid into the pump housing (40).

16. A pumped shower drain system as claimed in claim 15, wherein the second outlet valve seal (86) is a multi-cuspid valve (92).

17. A pumped shower drain system as claimed in claim 1, wherein the first and second inlet valve seals (56, 58) have different modes of operation.

18. A pumped shower drain system as claimed in claim 1, wherein the first and second outlet valve seals (84, 86) have different modes of operation.

19. A reciprocating water pump (20) for pumping waste water from a shower waste water unit (14) to a drain, the reciprocating water pump (20) comprising: a pump housing (40) having a pump inlet (48) for connection to a waste water outlet (30) of the waste water unit (14), and a pump outlet (50) for connection to a drain; first and second inlet valve seals (56, 58) in spaced relationship, the inlet valve seals (56, 58) being different kinds of seals from each other and being independently closable to close the pump inlet (48); and first and second outlet valve seals (84, 86) in spaced relationship, the outlet valve seals (84, 86) being different kinds of seals from each other and being independently closable to close the pump outlet (50).

* * * * *